US005167746A

United States Patent [19]

Sheenan

[11] Patent Number: 5,167,746

[45] Date of Patent: Dec. 1, 1992

[54] REPLACEMENT CRUTCH TIP METHOD

[76] Inventor: Maureen P. Sheenan, 6926 MacKenzie Rd. #2N, St. Louis, Mo. 63123

[21] Appl. No.: 640,620

[22] Filed: Jan. 14, 1991

[51] Int. Cl.[5] ..... A45B 9/04

[52] U.S. Cl. ..... 156/293; 52/DIG. 13; 135/77; 156/66; 123/29; 123/53

[58] Field of Search ..... 623/29, 53; 135/65, 135/66, 68, 77, 78; 248/915; 156/293, 66; 52/DIG. 13

[56] References Cited

U.S. PATENT DOCUMENTS

| | | | |
|---|---|---|---|
| 3,273,575 | 9/1966 | Aldrich | 135/77 |
| 3,551,914 | 1/1971 | Woodall | 623/53 |
| 4,345,956 | 8/1982 | Cox | 156/293 |
| 4,899,771 | 2/1990 | Wilkinson | 135/77 |

FOREIGN PATENT DOCUMENTS

| | | | |
|---|---|---|---|
| 8806431 | 9/1988 | World Int. Prop. O. | 623/53 |

*Primary Examiner*—Henry E. Raduazo
*Attorney, Agent, or Firm*—Leon Gilden

[57] ABSTRACT

A method of securing and enhancing a crutch tip for entertainment and psychological relief, wherein a shoe is provided with a conical plug removed from the shoe defining a conical opening therein, wherein the conical opening is coaxially aligned with a shoe opening aligned overlying the conical opening. A conical crutch tip is adhesively mounted with the conical opening and assembled to an associated lower terminal end of a crutch leg.

6 Claims, 4 Drawing Sheets

PRIOR ART

REPLACEMENT CRUTCH TIP METHOD

BACKGROUND OF THE INVENTION

1. Field of the Invention

The field of invention relates to crutches, and more particularly pertains to a new and improved crutch tip to provide a novelty and psychological relief when mounted to a crutch organization.

2. Description of the Prior Art

Crutch tips of the prior art are available for enhanced frictional contact with a support surface when an individual utilizes a crutch for ambulatory activity. Crutch tip structure is typically of a conical organization, but upon prolonged usage of crutches by individuals, it is desirable to provide psychological relief by providing a novelty crutch tip. Examples of prior art crutch structure may be found in U.S. Pat. No. 4,237,915 to Zabielski wherein a crutch tip is provided of an enlarged disk structure for securement to a lowermost end of a crutch organization.

U.S. Pat. No. 4,493,334 to Semanchik, et al. sets forth a crutch-type organization utilizing a tip or foot member of anatomically similar configuration to that of a human foot.

U.S. Pat. No. 3,289,685 to Parker sets forth a lower crutch tip organization for a conventional crutch tip or a platform utilizing a plurality of such crutch tips.

U.S. Pat. No. 3,731,698 to Buchalter wherein the tip of a cane or crutch structure is formed of a cylindrical segment, with a lowermost end for enhanced frictional engagement with a ground surface, with the crutch pivotally mounted to the cylindrical segment.

U.S. Pat. No. 4,098,283 to Tritle, Jr. wherein a crutch tip utilizes a convex lower surface for securement to a bottom of a crutch tip to engage sand and the like in use of the crutch.

As such, it may be appreciated that there continues to be a need for a new and improved replacement crutch tip method wherein the organization provides psychological relief, and in this respect, the present invention substantially fulfills this need.

SUMMARY OF THE INVENTION

In view of the foregoing disadvantages inherent in the known types of crutch tip structures now present in the prior art, the present invention provides a replacement crutch tip method wherein the same mounts a conventional shoe to a lowermost end of a crutch tip for psychological relief and respite from prolonged usage of a crutch organization. As such, the general purpose of the present invention, which will be described subsequently in greater detail, is to provide a new and improved replacement crutch tip method which has all the advantages of the prior art crutch tips and none of the disadvantages.

To attain this, the present invention provides a method of securing and enhancing a crutch tip for entertainment, wherein a shoe is provided with a conical plug removed from the shoe defining a conical opening therein, wherein the conical opening is coaxially aligned with a shoe opening aligned overlying the conical opening. A conical crutch tip is adhesively mounted with the conical opening and assembled to an associated lower terminal end of a crutch leg.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved replacement crutch tip method which has all the advantages of the prior art crutch tips and none of the disadvantages.

It is another object of the present invention to provide a new and improved replacement crutch tip method which may be easily and efficiently manufactured and marketed.

It is a further object of the present invention to provide a new and improved replacement crutch tip method which is of a durable and reliable construction.

An even further object of the present invention is to provide a new and improved replacement crutch tip method which is susceptible of a low cost of manufacture with regard to both materials and labor, and which accordingly is then susceptible of low prices of sale to the consuming public, thereby making such replacement crutch tip methods economically available to the buying public.

Still yet another object of the present invention is to provide a new and improved replacement crutch tip method which provides in the apparatuses and methods of the prior art some of the advantages thereof, while simultaneously overcoming some of the disadvantages normally associated therewith.

Still another object of the present invention is to provide a new and improved replacement crutch tip method wherein the same provides a convenient and readily securable manner of securing a show structure to a lowermost terminal end of an associated crutch leg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
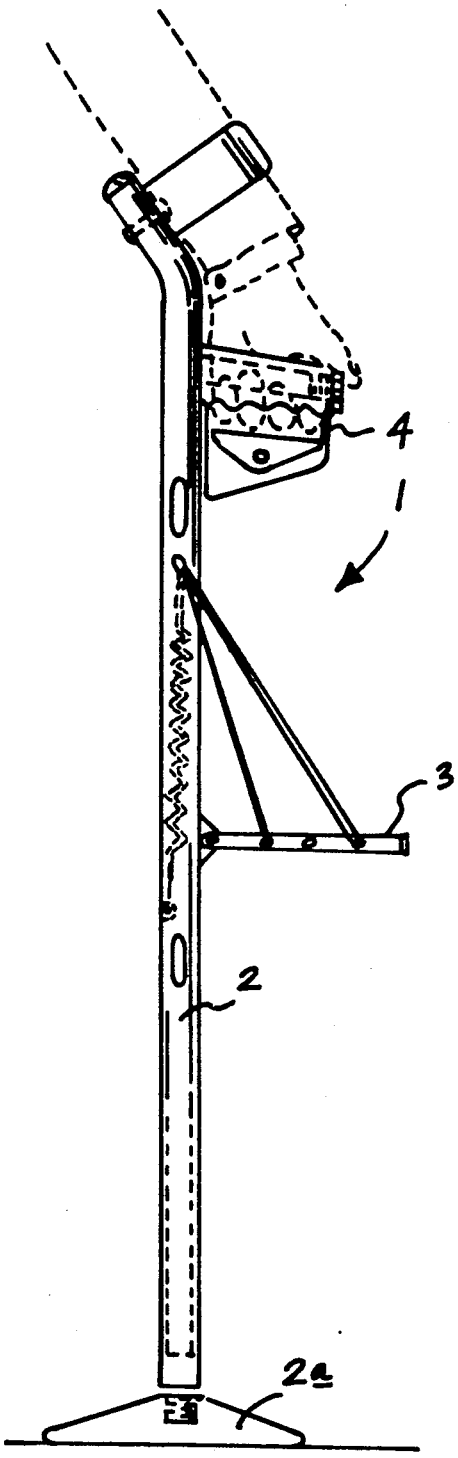
FIG. 1 is an orthographic side view, taken in elevation, of a prior art crutch structure.

With reference now to the drawings, and in particular to FIGS. 1 to 6 thereof, a new and improved replacement crutch tip method embodying the principles and concepts of the present invention and generally designated by the reference numerals 11–26 will be described.

Figure 2:
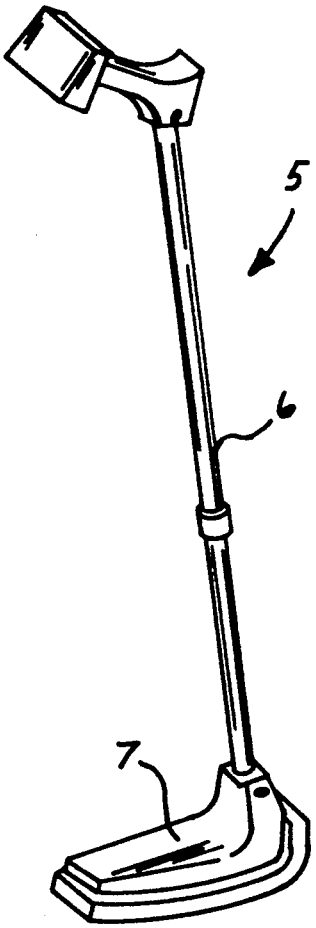
PRIOR ART FIG 2
FIG. 2 is an isometric illustration of a further prior art crutch structure.
Figure 3:
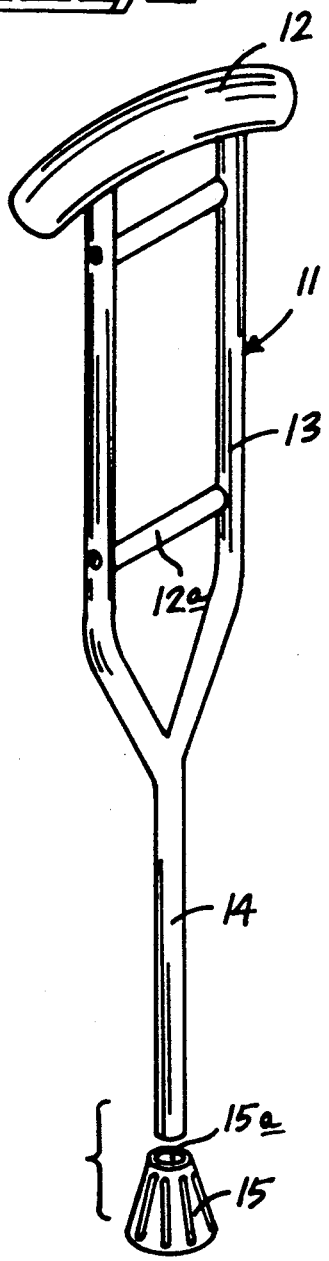
FIG. 3 is an isometric illustration of a crutch structure utilized by the instant invention.
Figure 4:
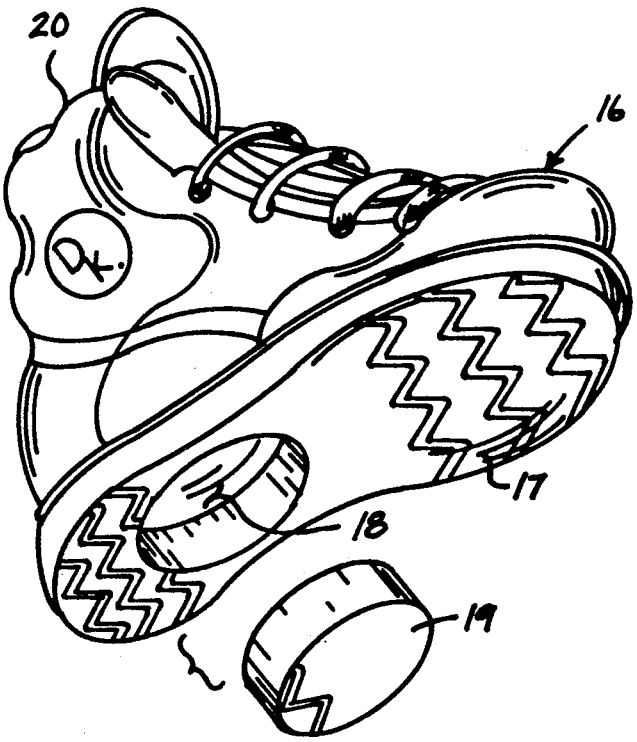
FIG. 4 is an isometric illustration of a preliminary step in the invention removing a conical plug from a shoe sole.

FIG. 1 illustrates a prior art crutch structure 1, wherein a central support leg 2 mounts a disk member 2*a* at a lowermost end thereof, with a shelf 3 pivotally mounted to the leg 2 underlying a hand support member 4. FIG. 2 illustrates a further prior art crutch structure 5, wherein a telescoping leg 6 mounts an anatomical similar foot structure 7 at a lowermost end thereof.

More specifically, the replacement crutch tip method 10 of the instant invention essentially comprises the providing of a crutch member 11, including an upper support 12 overlying and spaced from a lower support 12*a*, wherein the supports are integrally mounted to span spaced upper crutch legs 13. The upper legs 13 converge to a longitudinally aligned support leg 14 that terminates at a lowermost terminal end mounting a conical tip 15. The conical tip includes a cylindrical bore 15*a* to receive the lowermost terminal end of the support leg 14 therewithin. The conical tip 15 includes a frictional lower surface for frictional contact with the ground and the like for use of the crutch organization. A shoe 16 is provided, with the shoe 16 including a show upper defining a shoe entrance opening 20. A shoe sole 17 is coextensively mounted to the lower terminal end of the shoe upper of the associated shoe 16.

Figure 5:
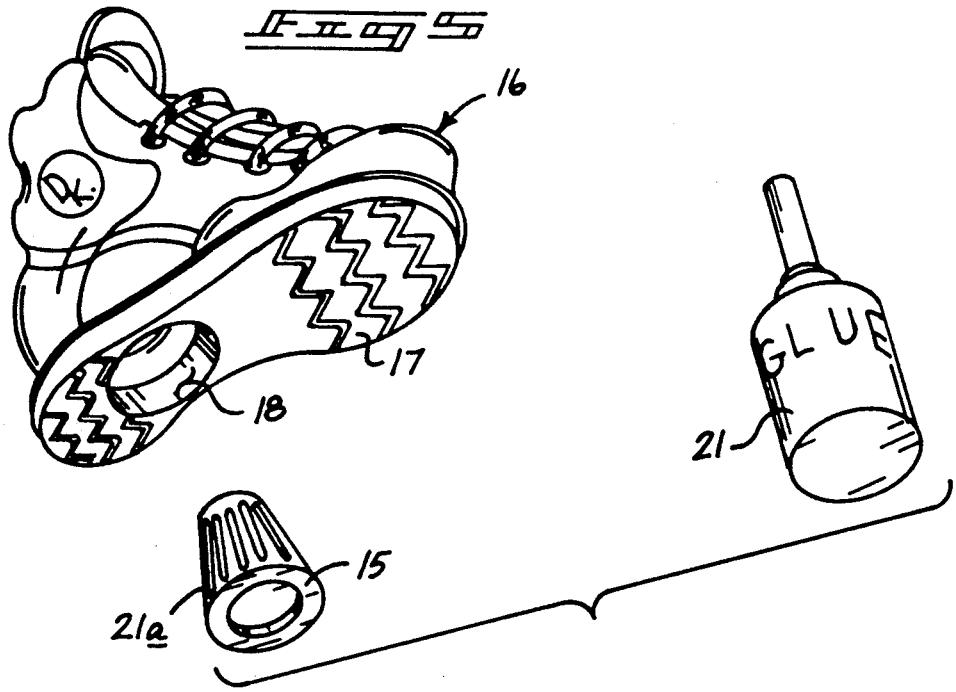
FIG. 5 is an isometric illustration of a further step of the instant invention in securing the crutch tip to the shoe sole.
Figure 6:
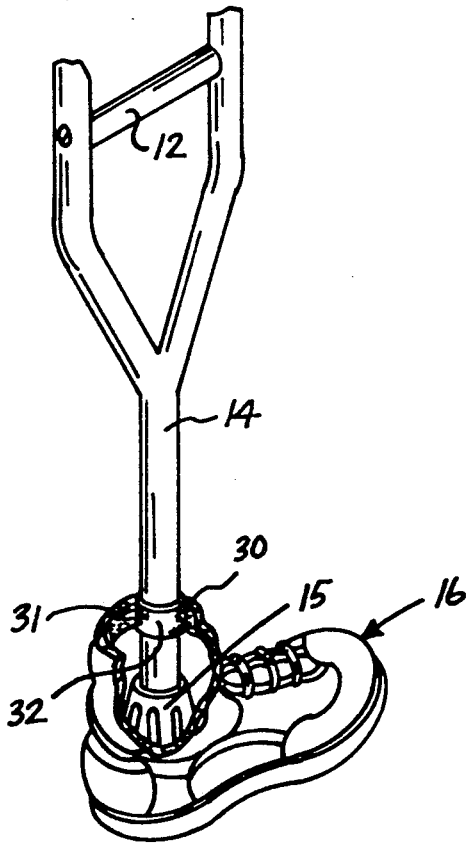
FIG. 6 is an isometric illustration, partially cut-away, illustrating the association of the crutch and shoe structure subsequent to assembly thereof.
Figure 7:
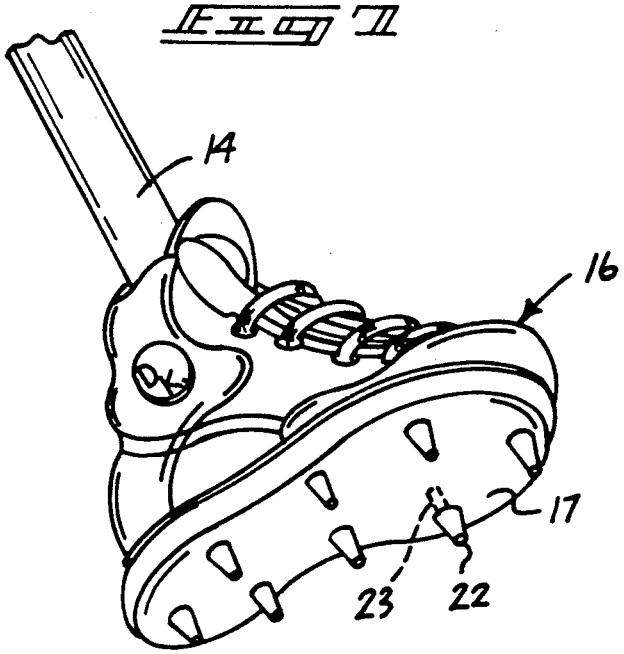
FIG. 7 is an isometric illustration of the instant invention securing a plurality of cleat members to the sole structure of the shoe.

Initially, a conical bore 18 is formed through the shoe sole 17 in coaxial alignment with the shoe entrance opening 20. The conical bore 20 is defined by the removal of a conical plug 19, wherein the conical bore 18 is defined by a complementary configuration to that of the conical tip 15 to complementarily receive the tip therewithin. Reference to FIG. 5 illustrates the use of an adhesive layer 21*a* applied to an exterior surface of the conical tip 15 from associated adhesive or glue container 21. The plug 15 is then inserted within the conical bore 18 permitting the adhesive 21*a* to cure and fixedly secure the conical tip 15 to the shoe sole 17. Subsequently, the lower terminal end of the support leg 14 is reinserted within the cylindrical bore 15*a* of the conical tip to provide the completed organization. If desired, as illustrated in FIG. 7, a matrix of conical cleat members 21 formed with threaded shanks 23 may be threadedly secured orthogonally relative to the shoe sole 17 to provide enhanced engagement with various ground surfaces such as sand, turf, and the like. FIG. 6 further indicates that the shoe upper includes an upper shoe terminal end 30 formed with a first hook and loop fastener surface 31 mounted adjacent the upper terminal end to an interior surface of the shoe upper. The first hook and loop fastener surface cooperates with the second hook and loop fastener surface mounted in a surrounding relationship relative to the support leg 14. This permits securement of the upper terminal end relative to the support leg to enhance orientation of the shoe relative to the support leg.

Figure 8B:
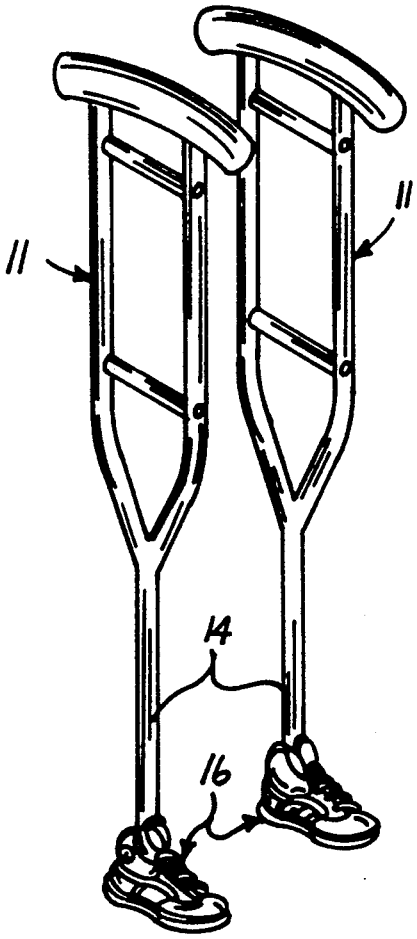
FIG. 8 is an isometric illustration of the instant invention illustrating the free standing characteristic of the crutch organization upon final assembly of the organization.

FIG. 8 illustrates the completed organization in a free-standing mode, wherein the enhanced surface support of the shoe sole 17 permits convenience in the vertical storage and positioning of the crutch structure when not in use.

It should be understood that various shoes and the like may be replaceably mounted to the lower terminal end of the support leg 14 to include such items as dress shoes, slippers, and the like dependent upon a social function or need of the user of the organization to permit that individual to selectively associate a particular shoe to a particular social function.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of securing a shoe to a crutch member, comprising the steps of, providing a crutch member, with the crutch member including at least one hand-grip fixedly mounted to a support leg structure, the support leg structure including a lower support leg, including a lower terminal end, wherein the lower terminal end mounts a conical tip thereon, the conical tip including a cylindrical bore to receive the lower terminal end of the support leg therewithin, and further providing a shoe, wherein the shoe includes a shoe sole and a shoe upper fixedly mounted to the shoe sole coextensive therewith, and the shoe upper including a shoe entrance opening formed through the shoe upper overlying the shoe sole, and forming a tip receiving bore through the shoe sole, and removing the conical tip from the support leg, and securing the conical tip within the tip receiving bore, and reassembling the support leg to the conical tip.

2. A method as set forth in claim 1 wherein the step of forming a tip receiving bore includes the step of forming the bore of a conical configuration complementary to the conical tip, and further coaxially aligning the tip receiving bore with the shoe entrance opening.

3. A method as set forth in claim 2 wherein the step of securing the conical tip within the tip receiving bore includes a step of applying an adhesive to an exterior conical surface of the conical tip, wherein the conical surface of the conical tip is positioned in confronting mating relationship with the tip receiving conical bore.

4. A method as set forth in claim 3 further including the step of securing a matrix of cleat members orthogonally to a bottom surface of the shoe sole about the tip receiving bore.

5. A method as set forth in claim 4 wherein the shoe upper includes an upper terminal end, and a first hook and loop fastener surface coextensively mounted to an interior surface of the shoe upper adjacent the upper terminal end is mounted, and further mounting a second hook and loop fastener surface to the lower support leg in surrounding relationship relative to the lower support leg, wherein the second hook and loop fastener surface is horizontally aligned relative to the first hook and loop fastener surface to permit securement of the upper terminal end of the shoe upper to the support leg.

6. A method as set forth in claim 4 further including the step of securing a matrix of cleat members orthogonally to a bottom surface of the shoe sole about the tip receiving bore.

* * * * *